United States Patent [19]

Sharp et al.

[11] Patent Number: 4,660,910

[45] Date of Patent: Apr. 28, 1987

[54] APPARATUS FOR ELECTRICALLY INTERCONNECTING MULTI-SECTIONAL WELL TOOLS

[75] Inventors: Stanley O. Sharp, Missouri City; John M. Dieken, Houston, both of Tex.

[73] Assignee: Schlumberger Technology Corporation, New York, N.Y.

[21] Appl. No.: 808,788

[22] Filed: Feb. 18, 1986

Related U.S. Application Data

[63] Continuation-in-part of Ser. No. 686,571, Dec. 27, 1984.

[51] Int. Cl.[4] ..... H01R 4/64

[52] U.S. Cl. ..... 339/16 R; 339/15

[58] Field of Search ..... 339/15, 16 R, 16 C, 339/16 RC

[56] References Cited

U.S. PATENT DOCUMENTS 4,039,237 8/1977 Cullen et al. ..... 339/16 R X

*Primary Examiner*—Eugene F. Desmond

[57] ABSTRACT

In the representative embodiment of the new and improved apparatus disclosed herein, a multi-section MWD tool is cooperatively arranged to include a plurality of separable tool bodies respectively carrying a pressure-tight enclosure with one or more electrical means and adapted to be tandemly coupled together to assemble a particular MWD tool. Mating electrical connectors connected to the electrical means are cooperatively supported in the threaded end portions of each tool body by mounting means uniquely arranged for selective manual adjustment to ensure reliable electrical connection to the connector in the next-adjacent tool body as well as to prevent the male threaded end portion of the adjacent tool body from damaging the connector in the female threaded end portion of the first tool body as the two bodies are being coupled together. Pressure-responsive means are also provided for biasing the mated electrical connectors together with sufficient force to withstand the extreme impact forces imposed on the MWD tool bodies as a well is being drilled.

16 Claims, 8 Drawing Figures

APPARATUS FOR ELECTRICALLY INTERCONNECTING MULTI-SECTIONAL WELL TOOLS

This is a continuation-in-part of U.S. application Ser. No. 686,571 filed Dec. 27, 1984.

BACKGROUND OF THE INVENTION

This invention relates to new and improved apparatus for reliably and quickly interconnecting electrical devices and electronic circuitry in a multi-section well tool when, for example, the tool is being assembled on a drilling rig. More particularly, the present invention relates to new and improved apparatus for interconnecting electrical means respectively enclosed in separable thick-walled tubular bodies which are tandemly coupled together by their respective threaded end portions. Mating electrical connector means connected to the electrical means in each tool body are cooperatively arranged to be selectively positioned within the tool bodies so that when the bodies are being threadedly coupled together, the mating connector means will be reliably interconnected without the male end portion of one tool body damaging the connector means as it is inserted into the female end portion of the other tool body and rotated to bring the bodies into coincidental alignment as their end portions are threadedly coupled together.

BACKGROUND ART

Those skilled in the art have long recognized the importance of obtaining various borehole measurements during the course of a drilling operation. Typically, these measurements include such data as the weight imposed on the drill bit, the torque applied to the drill string, the inclination and azimuthal direction of the borehole interval that is then being drilled, borehole pressures and temperatures, drilling mud conditions as well as various characteristics of the earth formations being penetrated. Heretofore most of these measurements were obtained either by temporarily positioning special measuring devices in the drill string or by periodically removing the drill string and employing suitable wireline logging tools.

In recent years, however, the drilling technology has advanced sufficiently that these measurements can now be readily obtained by so-called measuring-while-drilling or "MWD" tools that are tandemly coupled in the drill string and operated during the drilling operation. As described, for instance, in U.S. Pat. No. 4,303,994 and the several patents referred to therein, the MWD tools presently in commercial operation typically include a thick-walled tubular body carrying various sensors and their associated measurement-encoding circuitry which is preferably positioned in the drill string just above the drill bit for measuring the conditions at the bottom of the borehole. These commercial tools generally employ a selectively-operable acoustic signaler which is cooperatively arranged in the upper end of the tool body for successively transmitting encoded measurement signals through the drilling mud within the drill string to the surface where the signals are detected and recorded by suitable surface instrumentation.

It will be recognized that even the simplest MWD tool necessarily requires a considerable amount of downhole electronic circuitry and electrical apparatus for obtaining these downhole measurements, generating electrical power for the tool as well as selectively operating the acoustic signaler for successively producing the encoded signals in the mud stream. Because of the severe environmental conditions in a borehole, it is essential that this downhole circuitry and electrical apparatus be enclosed within elongated tubular enclosures or so-called "cartridges" which are coaxially supported in the axial mud passage through the tool body. Since the drilling mud flowing through the tool should not be unduly obstructed, these instrumentation cartridges must be relatively small in diameter and, for even the simplest MWD tool, of considerable length to accommodate the circuitry and electrical devices for that tool.

Those skilled in the art will, of course, recognize that with only a single tool body, the various electrical devices can be interconnected by conventional connectors and mounted in one or more sealed cartridges that can be readily installed in the tool body. Nevertheless, the substantial weight of these thick-walled bodies will significantly limit the maximum overall length of a given tool body as well as its associated cartridges. This restriction to the overall length of the cartridges will, of course, correspondingly limit the number of measurements that a given tool can obtain. It should also be noted that where one or more measurements are unduly affected by magnetic materials, the overal cost of the MWD tool will be substantially increased if it is necessary to construct the tool body of a suitable nonmagnetic stainless steel.

Thus, it would appear that the ideal MWD tool should be arranged as a multi-sectional tool having various special-purpose cartridges that are respectively housed in separable thick-walled bodies and suitably arranged to be coupled together in various combinations for assembling a MWD tool capable of obtaining one or more selected measurements. One obvious advantage of such a multi-sectional tool is that a tool section which either is not needed for a particular operation or is malfunctioning can be quickly removed without disturbing the other sections of the tool. Those skilled in the art will, however, recognize that for a multi-sectional MWD tool to be suited for commercial service, the tool should be easily and quickly assembled and disassembled by using the rig tongs while the tool is supported in the slips on the rotary table of the drilling rig. This, of course, makes it preferable that the separable tool bodies utilize threaded end portions which tapered threads such as those customarily used for drill collars or joints of drill pipe.

Nevertheless, despite the advantages of such a multi-sectional tool, it is essential that the electrical connectors in the tool bodies be protected from damage since these tapered threads permit the male member to enter the female member for a considerable distance before the threads become sufficiently coengaged to axially align the tool bodies. Another common problem is that when any tool is assembled while hanging in the slips on a rotary table, the threads on these thick-walled bodies will be damaged from time to time even though every precaution is used in handling the bodies. If the damage to the threads is not severe, the tool body may be returned to service after the threads are redressed. If the damage is more serious, the tool body must be reconditioned either by cutting off th damaged threads and rethreading the damaged end portion or by replacing the entire threaded end portion. In any event, once the tool body has been reconditioned, its overall length will be changed; and, before that body can be reused, some modification must be made to the connector means or to any cartridge that is to be subsequently placed in that body before other tool bodies can be utilized with the reconditioned body.

OBJECTS OF THE INVENTION

Accordingly, it is an object of the present invention to provide new and improved electrical connector means for multi-sectional measuring-while-drilling tools which are adapted for cooperatively interconnecting electrical devices respectively enclosed within separable tool bodies and without damaging the electrical connector means as the bodies are being coupled to one another.

It is a further object of the present invention to provide new and improved means for supporting interchangeable pressure-tight enclosures within tool bodies of various lengths and cooperatively positioning electrical connectors near the ends of these bodies where they will not be damaged as the tool bodies are coupled together and the electrical connectors interconnected with those in the other tool bodies.

SUMMARY OF THE INVENTION

These and other objects of the present invention are attained by new and improved upper and lower head assemblies that are cooperatively arranged to be respectively mounted at the opposite ends of the axial bore of an elongated tool body. These head assemblies respectively include first electrical connector means having outwardly-directed contact members coaxially mounted in the tool body. At least one of the first electrical connector means in each tool body is cooperatively arranged for being initially positioned at a selected location on the longitudinal axis of the tool body so that as the body is being threadedly coupled to other similarly threaded bodies, their respective contact members will be safely brought into mating engagement with one another. The head assemblies of the present invention further include inwardly-directed socket means respectively arranged for cooperatively supporting and fluidly sealing a tubular housing carrying electrical means. The head assemblies further include second connector means cooperatively arranged for releasably interconnecting the first connector means with the electrical means supported within the tool body.

BRIEF DESCRIPTION OF THE DRAWINGS

The novel features of the present invention are set forth with particularity in the appended claims. The invention, together with further objects and advantages thereof, may best be understood by way of illustration of the following description of exemplary apparatus employing the principles of the invention as illustrated in the accompanying drawings, in which:

DESCRIPTION OF A PREFERRED EMBODIMENT

Figure 1:
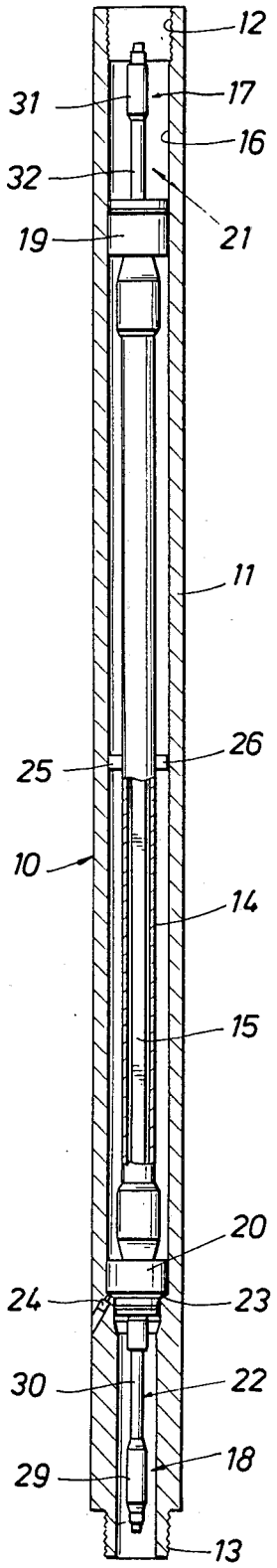
FIG. 1 is a cross-sectioned elevational view of a preferred embodiment of a typical tool section incorporating the principles of the invention and which is cooperatively arranged to be threadedly coupled to other similar sections for assembling a multi-sectional MWD tool adapted to be tandemly coupled in a drill string.

Turning now to FIG. 1, a new and improved tool section or so-called "instrumentation sub" 10 arranged in accordance with the principles of the present invention is depicted as it will appear before it is coupled to a similar sub for assembling a MWD tool equipped for obtaining one or more selected downhole measurements. To assemble the multi-sectional MWD tool, one or more instrumentation subs, as at 10, having the necessary instrumentation and measurement circuitry are coupled to other subs (not shown in the drawings) carrying a mud-driven generator for powering the tool and an acoustic signaling device. The assembled MWD tool is tandemly coupled in a drill string just above the drill bit and operated during the course of a drilling operation for successively measuring the downhole conditions and transmitting those measurements to the surface. Inasmuch as the present invention is not limited to any particular MWD system, U.S. Pat. No. 4,303,994 as well as the other patents referred to therein are hereby incorporated by reference as disclosing representative MWD systems in which the new and improved electrical connectors of the present invention can be effectively employed.

In particular, it will be seen from FIG. 1 that the instrumentation sub 10 is basically comprised of an elongated, thick-walled tubular body 11 having its upper and lower end portions respectively provided with female and male threads 12 and 13 which are preferably the same as used for conventional drill collars of the same external diameter. A fluid-tight tubular housing or cartridge 14 is coaxially mounted within the tool body 11 and arranged to enclose electrical means such as various electrical devices or electronic circuitry 15 to obtain measurements or perform given functions related to the overall operation of the MWD tool. In keeping with the principles of the present invention, the cartridge 14 is made significantly shorter than the thick-walled tubular body 11 and is centrally positioned therein for providing substantial clearance spaces in the upper and lower portions of its axial bore 16 in which new and improved upper and lower head assemblies 17 and 18 are mounted. As will subsequently be described in more detail, these head assemblies 17 and 18 respectively include central support members or bodies 19 and 20 which sealingly receive the upper and lower ends of the cartridge 14 and coaxially position the cartridge within the tool body 11. The head assemblies 17 and 18 also include electrical connector means 21 and 22 cooperatively arranged on the bodies 19 and 20 for releasably interconnecting the electrical means 15 in the cartridge 14 with electrical means in other tool subs that may be coupled to the sub 10 to assemble a given multi-sectional MWD tool.

To coaxially support the cartridge 14 in the tool body 11, the lower portion of its axial bore 16 is reduced in diameter to define an upwardly-facing shoulder 23 on which the central body 20 of the lower head assembly 18 is rested and secured by means such as one or more bolts 24 in the lower portion of the thick-walled body. Should the cartridge 14 be particularly long, one or more centralizing members, as at 25, may also be mounted on intermediate portions of the cartridge 14 to prevent its unwanted lateral movement within the tool body 11. To facilitate the flow of drilling mud through the body 11, bypass passages 26 are appropriately arranged in the centralizing member 25 and, as shown at 27 and 28 in FIGS. 3 and 4, in the central bodies 19 and 20 respectively.

Figure 2:
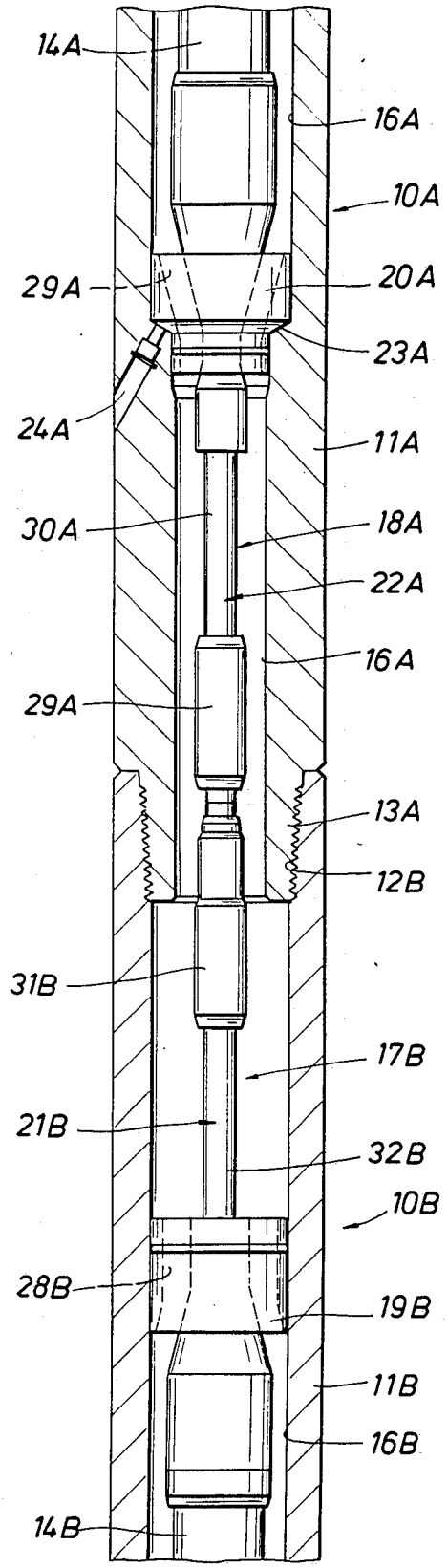
FIG. 2 is a partially cross-sectioned elevational view of the upper and lower end portions of two tandemly-coupled tool sections such as the one depicted in FIG. 1 to illustrate the interconnection of two connector means of the invention.

Turning now to FIG. 2, the adjacent end portions of two tool subs 10A and 10B which are respectively arranged in accordance with the principles of the present invention are depicted as they will appear when they are tandemly coupled together to assemble a MWD tool requiring the electrical means in the cartridges 14A and 14B. As previously described, the upwardly facing shoulder 23A serves to position the lower head assembly 18A well above the lower end of the tool body 11A. This, in turn, requires that the electrical connection means 22A of the lower head assembly 18A include a downwardly-facing electrical connector 29A that is coaxially positioned within the axial bore 16A just above the lower end of the tool body 11A by an elongated support member 30A that is dependently coupled to the central body 20A. Similarly, the upper head assembly 17B of the sub 10B is positioned well below the upper end of the tool body 11B. Accordingly, the electrical connection means 21B of the upper head assembly 17B include an upwardly-facing electrical connector 31B adapted for mating engagement with the connector 29A. The connector 31B is coaxially aligned within the axial bore 16B and positioned just below the upper end of the tool body 11B by an upright tubular support member 32B coaxially mounted to the upper end of the central body 19B. As will subsequently be explained, the mating electrical connectors 29A and 31B are cooperatively arranged to interconnect the electrical means respectively enclosed within the two cartridges 14A and 14B.

Figure 3:
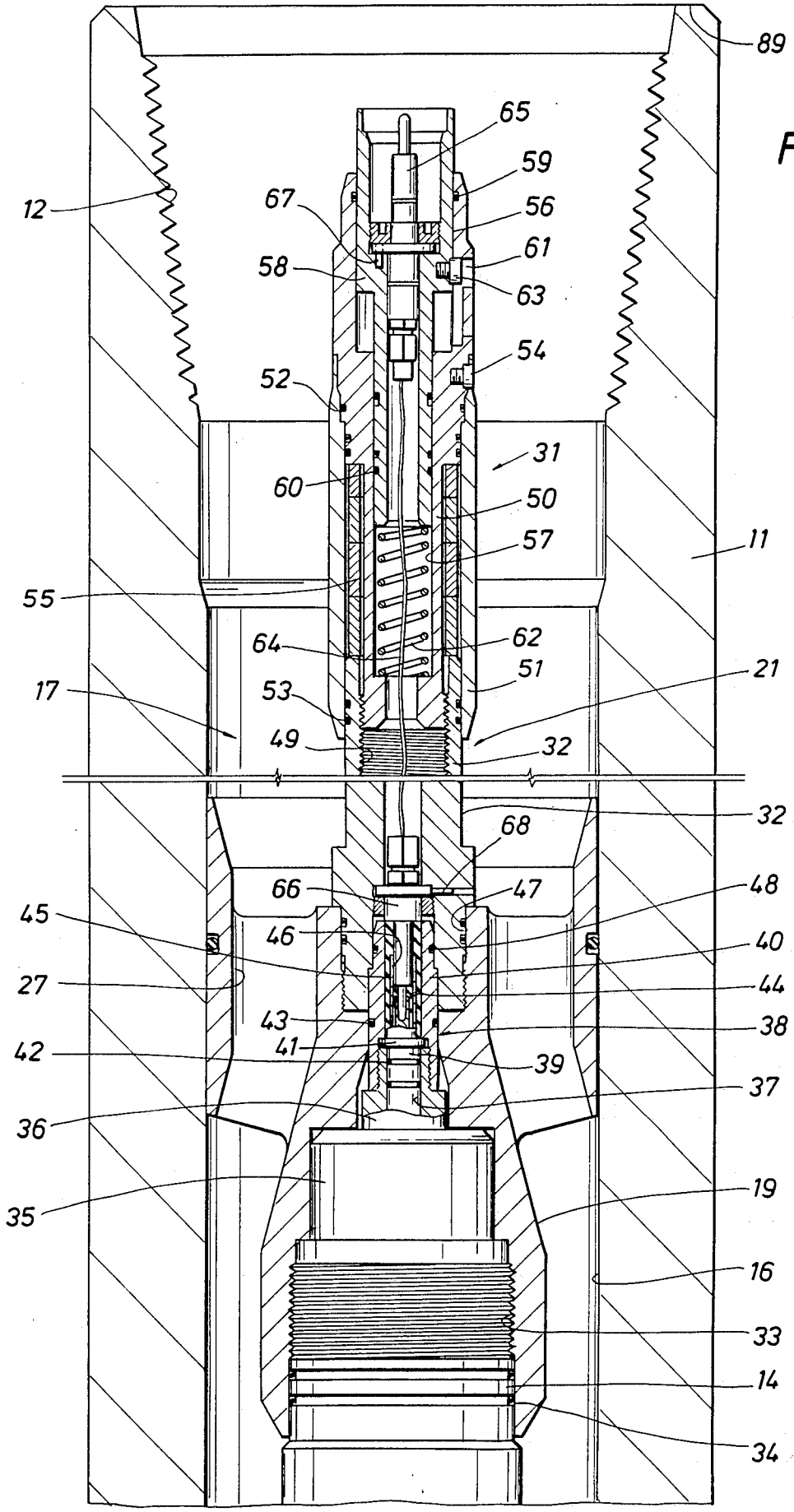
FIGS. 3 and 4 depict new and improved head assemblies arranged in accordance with the principles of the invention that are respectively mounted in the upper and lower end portions of thick-walled tool bodies.

Turning now to FIG. 3, a partially cross-sectioned, elevational view is shown of the upper and lower portions of the upper head assembly 17 in the upper end of the tool body 11. As depicted in FIG. 3, the upper end of the cartridge 14 is threadedly engaged within a downwardly-facing threaded socket 33 coaxially arranged in the lower end of the central body 19 and fluidly sealed therein by means such an O-ring 34. A closure member 35 fitted in the upper end of the cartridge 14 is terminated by a reduced-diameter end portion 36 with an axial bore 37 carrying an electrical connector 38 connected to one or more conductors from the electrical means 15 (not seen in FIG. 3) enclosed in the cartridge.

The electrical connector 38 includes a body 39 with an upwardly-opening axial bore which is fitted within the axial bore 37 of the closure member 35 and secured by a tubular retainer 40 that is threadedly engaged over the upright end portion 36 of the closure member to press an external rib 41 around the connector body against the upper transverse surface of the end portion. Sealing means, such as O-rings 42 and 43 respectively mounted around the connector body 39 and the retainer 40, are arranged for blocking the entrance of drilling mud into the socket 33 and the upper end of the cartridge 14. To provide coaxially-aligned, axially-spaced electrical contacts within the connector body 39, the electrical connector 38 further includes at least two contact members which, in the illustrated preferred embodiment of the upper head assembly 17, are comprised of a small conductive sleeve 44 coaxially disposed in the rearward portion of an insulating sleeve 45 and a larger conductive ring 46 coaxially mounted in the forward end portion of the insulating sleeve.

To properly position the electrical connector 31 in relation to the upper end of the body 11, the lower end of the upright support member 32 is fitted over the retainer member 40 and threadedly secured within an upwardly facing counterbore 47 in the upper end of the central body 19. Sealing means, such as an O-ring 48 between the retainer 40 and the support member 32, prevent the entrance of drilling mud into the support member. As depicted in FIG. 3, in the preferred embodiment of the electrical connector means 21, the upper portion of the tubular support member 32 is internally threaded as at 49. The reduced-diameter lower end of a tubular connector body 50 is threadedly engaged within the threads 49 and adapted to be manually moved upwardly or downwardly as needed to correctly position the electrical connector 31 for subsequent mating engagement with another connector (such as the connector 29 in another tool sub) whenever the sub 10 is used to assemble a particular MWD tool.

The connector 31 further includes a protective sleeve 51 which is coaxially mounted around the mid-portion of the body 50 and the upper end of the support member 32. Sealing means such as O-rings 52 and 53 are cooperatively arranged to prevent the entrance of drilling mud into the electrical connector 31. A screw 54 secures the protective sleeve 51 to the connector body 50. Should it be needed to provide additional strength for the support 32 to better withstand axially directed impacts and thereby protect the threads 49, one or more annular spacers, as at 55, may be stacked in the space between the connector body 50 and the sleeve 51 and engaged between the upper surface of the support member 32 and the lower surface of the enlarged-diameter mid-portion of the connector body. The lengths and number of these spacers 55 will, of course, be dependent upon where the electrical connector 31 is to be positioned on the support 32.

The connector body 50 is counterbored to provide an enlarged-diameter axial bore 56 in the upper portion of the body and a reduced-diameter axial bore 57 in the lower portion of the connector body. As illustrated in FIG. 3, an elongated tubular member 58 having an enlarged-diameter upper portion and a reduced-diameter lower portion is slidably mounted in the upper and lower portions 56 and 57 of the axial bore of the connector body 50 for limited axial movement therein. For reasons which will subsequently be explained, sealing means such as O-rings 59 and 60 are cooperatively arranged between the connector body 50 and the slidable member 58. An elongated slot 61 is provided in the connector body 50 between the O-rings 59 and 60. Biasing means, such as a spring 62 in the axial bore 57, are provided for normally urging the slidable member 58 upwardly in relation to the connector body 50 and toward an elevated position as defined by stop means such as a set screw 63 one side of the slidable member that has its head slidably disposed within the slot 61.

In accordance with the principles of the present invention, the upper connector means 21 are arranged to quickly and reliably interconnect the electrical means in the cartridge 14 and the electrical means in another sub. In the preferred manner of accomplishing this, a multi-conductor cable 64 is disposed within the tubular extension member 32. The cable 64 is provided with a typical male connector 65 on its upper end that is seated in an upright position within the slidable member 58 and a typical male connector 66 on its lower end cooperatively arranged to be progressively inserted into the female connector 38 as the lower end of the extension member 32 is being threaded into the threaded socket 47 on the central body 19. To prevent the cable 64 from rotating relative to the extension member 32, the upper connector 65 is preferably secured to the slidable member 58 by an upright pin 67 and the lower connector 66 is secured to the extension member by a lateral pin 68.

Accordingly, it will be appreciated that the upper connector means 21 are cooperatively arranged to be removed by simply unthreading the extension member 32 from the socket 47 in the upper end of the central body 19. Once the upper connector means 21 are separated from the central body 19, the connector 31 can be selectively positioned on the extension member 32 by temporarily removing the set screw 54 and moving the protective sleeve 51 downwardly onto the extension member 32. The connector body 50 must, of course, be temporarily removed if it is found necessary to remove or add spacer members as at 55. If the spacer members, as at 55, are not being used, it will be recognized that the connector body 50 can be readily moved upwardly or downwardly along the threads 49 without having to first remove the body from the extension member 32. In any event, once the connector body 50 is accurately positioned by means of the threads 49 (and, if the spacers 55 are used, the body is firmly engaged against the stacked spacers), the sleeve 51 is resecured to the connector body with the screw 54.

Figure 4:
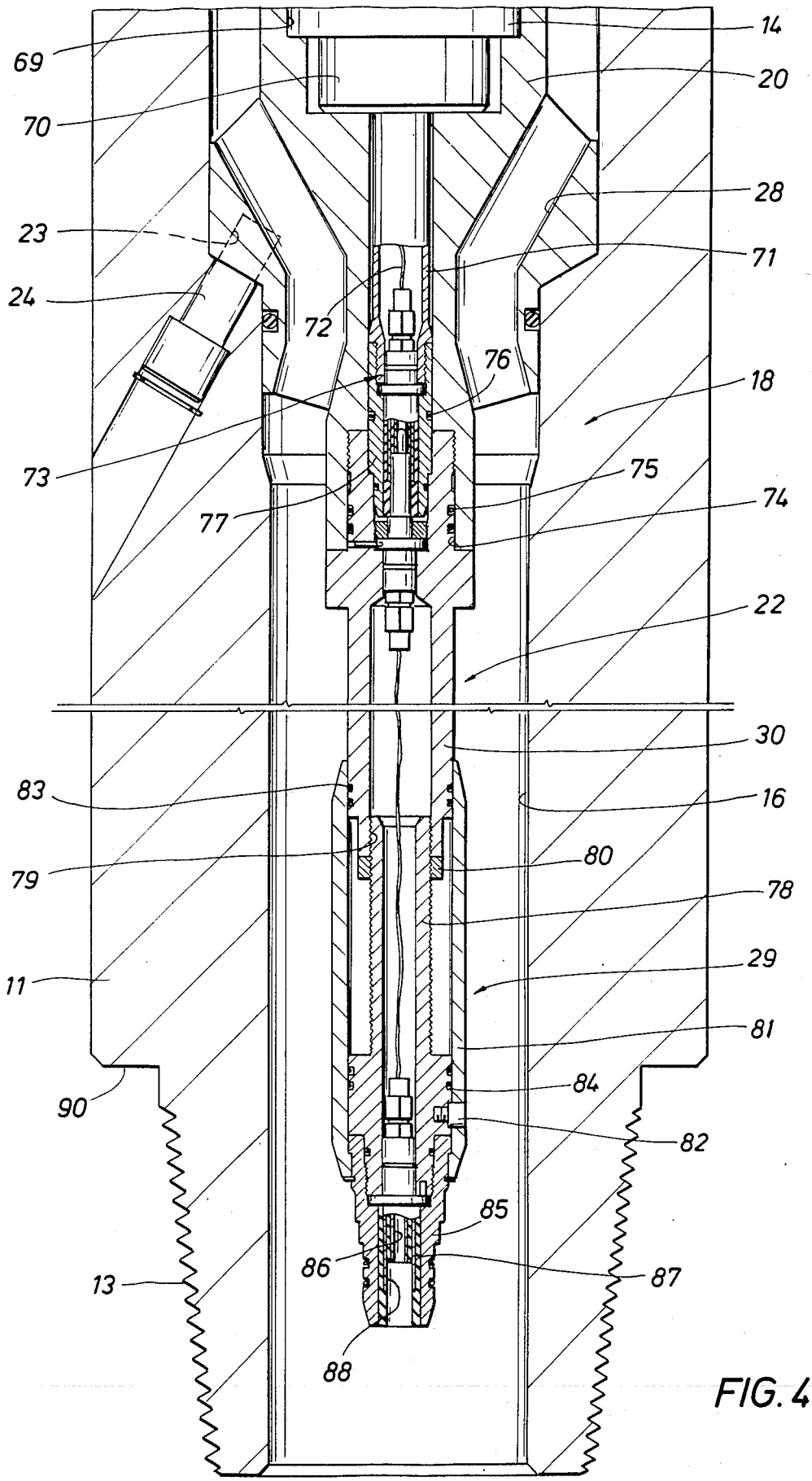

Turning now to FIG. 4, the lower head assembly 18 of the present invention is seen as it will appear when mounted within the lower portion of the thick-walled sub body 11. As illustrated, the lower end of the cartridge 14 is cooperatively received within an upwardly facing socket 69 coaxially arranged in the central body 20 and fluidly sealed and secured therein in a typical fashion. In the depicted preferred embodiment of the lower head assembly 18, a closure member 70 disposed within the lower end of the cartridge 14 is terminated with a reduced-diameter tubular end portion 71 carrying a multi-conductor cable 72 which is connected to the electrical means within the cartridge and terminated by a downwardly-facing electrical connector 73 which is preferably similar or identical to the female connector 38. The upper end of the tubular support member 30 is coaxially disposed around the connector 73 and threadedly engaged within a downwardly facing socket 74 in the lower end of the central body 20. Sealing means, such as an O-ring 75 between the central body 20 and the extension member 30 and an O-ring 76 between the central body and a retainer 77 on the connector 73, are cooperatively arranged for blocking the entrance of drilling mud into the lower end of the cartridge 14.

The lower connector 29 is preferably similar to the connector 31 and includes a tubular body 78 that is threadedly coupled to internal threads 79 within the lower portion of the depending support member 30 and secured by a lock nut 80 once the connector body has been properly positioned. A protective sleeve 81 is coaxially mounted around the connector body 78 and secured thereto as by a set screw 82. Sealing means, such as O-rings 83 and 84, are cooperatively arranged between the connector body 78 and the sleeve 81 for sealingly enclosing the interior of the support member 30. A tubular body 85 is threadedly coupled to the lower end of the connector body 78 and arranged to carry a small conductive sleeve 86 coaxially disposed in the upper portion of an insulating sleeve 87 and a larger conductive ring 88 coaxially mounted in the lower portion of the insulating sleeve. It will, of course, be recognized that these contacts 86 and 88 are sized and positioned within the insulating sleeve 87 to provide a female connector adapted to complementally receive a typical bayonet-type male connector (such as the connector 65) that is mounted in a companion tool sub that is being coupled to the instrumentation sub 10.

To prepare the instrumentation sub 10 for assembly into a MWD tool requiring the electrical means 15, the closure members 35 and 70 are respectively mounted in the upper and lower ends of the cartridge 14 and the connectors 38 and 73 are secured in position by their respective retainers 40 and 77. The upper and lower central bodies 19 and 20 are then fitted over the upper and lower ends of the cartridge 14 and this assembly is thereafter inserted into the axial bore 16 of the tool body 11. Once the assembly is properly positioned within the tool body 11, the screws 24 are tightened to secure the lower central body 20 to the tool body. It will, of course, be recognized that removal of the cartridge 14 is carried out by simply reversing this assembly procedure.

It will be appreciated from FIGS. 3 and 4 that once the cartridge 14 and its respective end assemblies 17 and 18 are in position within the tool body 11, the upper and lower electrical connector means 21 and 22 can be readily removed or installed. For instance, should it be desired to remove the upper connector means 21, the upright support member 30 is simply rotated as required to disengage it from the threaded socket 47. This, of course, removes the upper connector 31 along with the upper support member 30. Once this is done, the connector body 50 can be manually rotated for moving the connector body upwardly or downwardly along the threads 49 so as to position the upper connector 31 in a desired location with respect to the upper end of the tool body 11. As depicted in FIG. 3, once the upper connector 31 has been appropriately adjusted on the support member 32, the upper or forward end of the slidable member 58 will be spatially disposed a fixed distance below or to the rear of the transverse surface 89 on the upper female or box end of the tool body 11. Since this transverse end surface 89 must necessarily engage the opposing transverse surface or shoulder, as at 90 in FIG. 4, just behind the male threads, as at 13, when the tool body 11 is tightly coupled to another tool body or sub, this longitudinal spacing will provide a standard measure for correctly positioning the connector 31 (as well as the connector 29). It will, of course, be recognized that the lost-motion connection provided for the slidable body 58 will enable the slidable body to move downwardly or inwardly against the spring 62 should there be a minor discrepancy in the longitudinal positioning of either of the mating connectors 29 or 31.

It will, of course, be readily appreciated from FIG. 4 that the lower electrical connection means 22 are similarly arranged to facilitate the accurate positioning of the lower connector 29. By removing the set screw 82 and sliding the protective sleeve 81 upwardly, the lock nut 80 can be temporarily loosened to permit spatial adjustment of the connector body 78 along the internal threads 79. Hereagain, the end of the tubular nose portion 85 must be positioned a fixed distance ahead of or below the transverse surface or external shoulder 90 of the tool body 11. It will be recognized that adjustment of the lower connector 29 is preferably carried out with the connecting means 21 mounted outside of the tool body 11. Accordingly, it will be seen that the electrical connector means 21 and 22 permit the upper and lower connectors 31 and 32 to be adjustably positioned independently of one another as needed to accommodate changes in the overall length of the tool body 11 as might be necessary where the threads 12 or 13 have been reconditioned.

Figure 5:
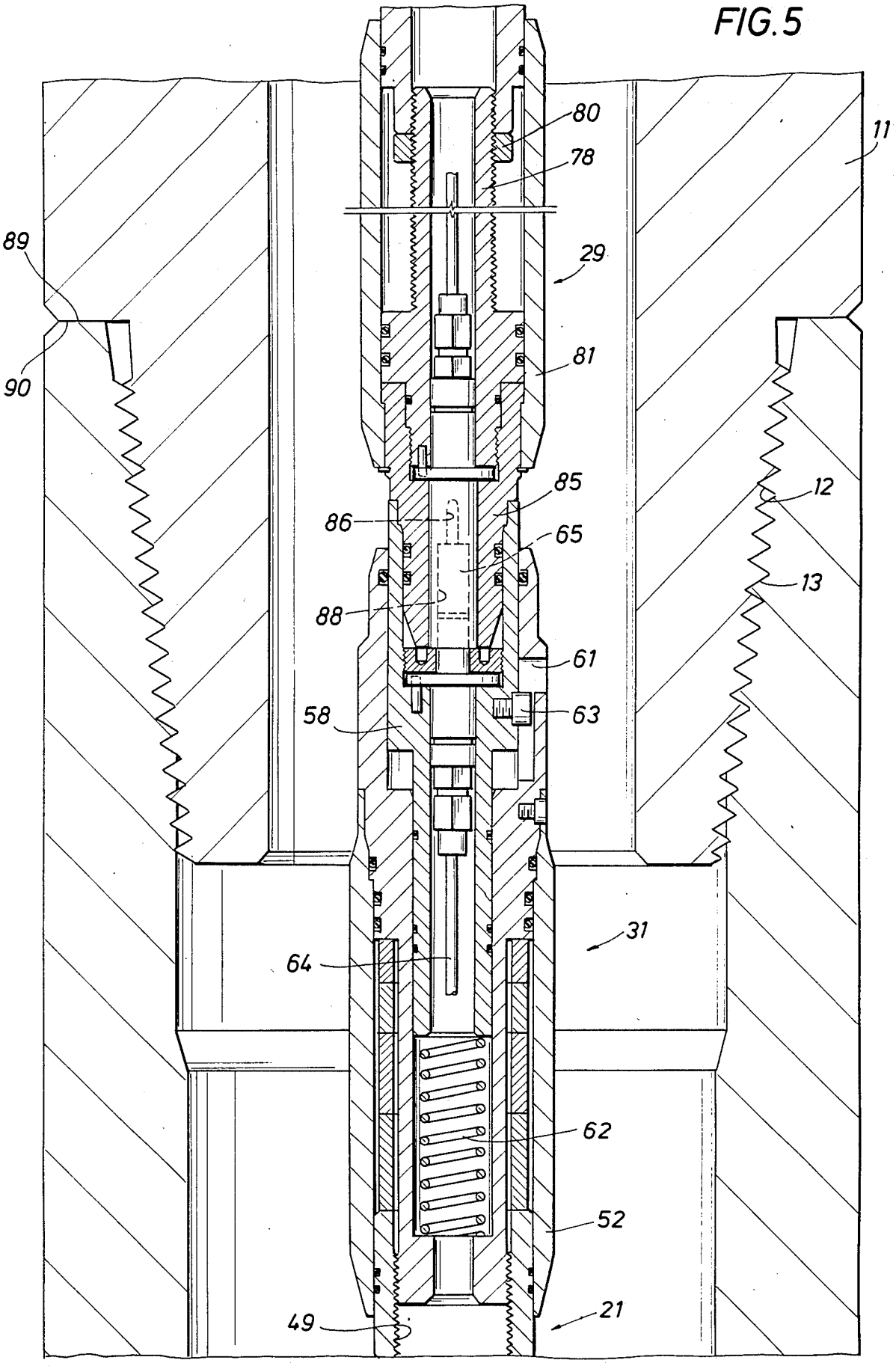
FIG. 5 shows further details of how the connector means of the present invention will appear when connected.

Turning now to FIG. 5, an enlarged view is shown of the bottom end of the body 11 to illustrate the interconnection of one of the lower connectors 29 with one of the mating upper connectors 31. It will be appreciated that before the tool 10 can be properly assembled, the connectors 29 and 31 must be correctly positioned in relation to their respective tool bodies 11. The extent of any preliminary adjustments will, of course, depend upon whether there has been a significant change in the relative positions of either of the connectors 29 or 31 with respect to its particular tool body 11. For instance, at times it will be necessary to remove the cartridge 14 and the upper and lower head assemblies 17 and 18 from a particular tool body 11 for repairing or replacing one of the threaded end portions as at 12 or 13. The change in the length of the tool body 11 resulting from such repairs or replacements will, of course, require that one or both of the connectors 29 and 31 be appropriately adjusted so that when the tool sub 10 is reassembled they will be properly positioned within the tool body.

Accordingly, in keeping with the objects of the present invention, the upper and lower connector means 21 and 22 are removed from the central bodies 19 and 20 by unthreading the support members 30 and 32 before the tool sub 10 is reassembled. The cartridge 14 and the upper and lower head assemblies 17 and 18 are then installed in the body 11 and secured in place by the bolts 24. To adjust the lower connector 29, the protective sleeve 81 is temporarily removed and the lock nut 80 is loosened so that the tubular member 78 may be appropriately raised or lowered along the threads 79 as needed for correctly positioning the nose of the connector body 85 in relation to the external shoulder 89 on the lower end of the tool body 11. It should be noted that even if the length of the tool body 11 has been significantly changed (such as when a damaged threaded end portion has been replaced), the overall length of the threads 79 provides substantial latitude for adjusting the tubular member 78 so that the connector 29 will be accurately positioned when the connector means 22 are subsequently replaced in the tool body. In an extreme situation, the tubular support 30 could, of course, be easily replaced with a shorter or longer support member. Once the connector 29 is correctly positioned on the lower support member 30, the lock nut 80 is retightened and the sleeve 81 replaced and secured to the member 85 by the set screw 82. The support member 30 is then threadedly engaged in the socket 74 in the lower central body 20. Measurements can be made to determine the longitudinal spacing between the lower end of the lower connector 29 and the shoulder 90 at the lower end of the tool body 11. The support member 30 can, of course, be readily unthreaded from the lower central body 20 should it be necessary to adjust the position of the connector 29 in relation to the lower surface or shoulder 90 of the tool body 11.

In a like fashion, the upper connector 31 is also correctly positioned on the extension member 32 before the upper connector means 21 are secured to the upper central body 19. Once the protective sleeve 51 is removed from the connector 29, a stack of the annular spacers 55 of appropriate height is arranged on top of the extension member 32 and secured in place when the connector body 50 is adjusted on the threads 49. Once the connector body 50 has been tightened down on the stacked spacers 55, the sleeve 51 is replaced and the extension member 32 is threaded into the socket 47 of the upper central body 19. It will be realized that the extension member 32 can also be readily removed from the central body 19 should the connector 29 require a minor readjustment to correctly position it in relation to the upper shoulder 89 of the tool body 11.

It will be appreciated that the above-described adjustments of the upper and lower connector means 21 and 22 can be easily carried out with only a minimum of skill needed to correctly position the connectors 29 and 31. Those skilled in the art recognize, of course, that the pressure of time and the working conditions on a rig floor are often such that delicate adjustments or complicated equipment changes can not always be made. Thus, in accordance with the objects of the present invention, the unique arrangement of the connector means 21 and 22 facilitate the replacement of sealing members and the correct positioning of the connectors 29 and 31 in a minimum of time by even unskilled personnel.

As best illustrated in FIG. 3, whenever the upper connector 31 is not matingly engaged with the lower connector 29, the spring 62 will urge the body 58 upwardly until the screw 63 engages the upper surface of the slot 61. As shown in FIG. 5, however, the spring 62 will be slightly compressed when one of the lower connectors 29 on another tool sub is inserted into the upper connector 31 so that the screw 63 will be disengaged from the upper surface of the slot 61. The biasing force of the spring 62 will, of course, tend to maintain the connectors 29 and 31 firmly engaged. Those skilled in the art will nevertheless recognize that the extreme shock forces that are continuously imposed on a MWD tool during a drilling operation could easily overcome this biasing force and thereby momentarily separate the connectors 29 and 31. Accordingly, as a further aspect of the invention, it will be recognized that by virtue of the O-rings 59 and 60 and the enlarged-diameter and reduced-diameter upper and lower portions of the slidable member 58, the pressure of the drilling mud flowing through the axial bore 16 of the tool body 11 will be effective for imposing an upwardly directed biasing force against the slidable member. This upward pressure-biasing force will, of course, urge the upper connector 31 against the lower connector 29 in the adjacent tool body so as to keep the connectors firmly connected while the MWD tool 10 is being operated.

Figure 6C:
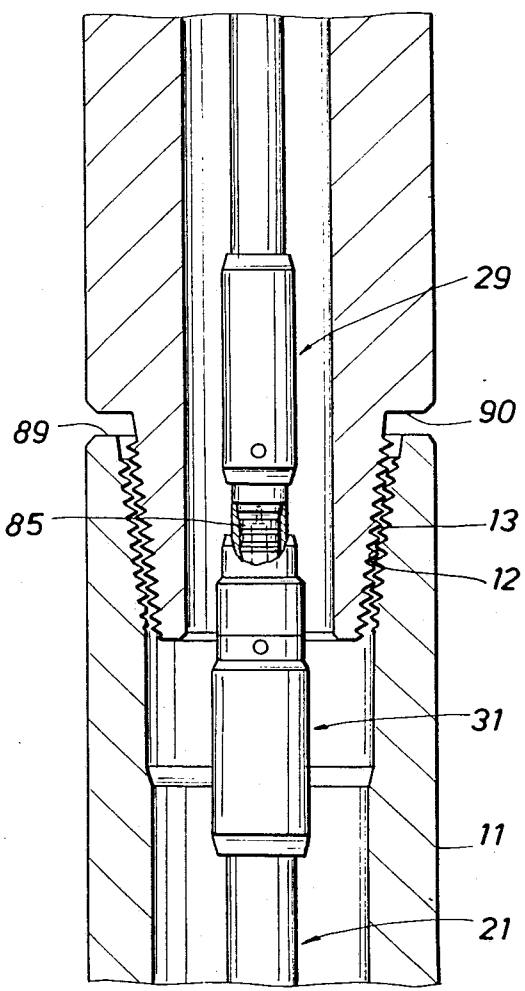
FIGS. 6A–6C are cross-sectional views showing two tool bodies respectively provided with the connector means of the invention as these bodies are being threadedly coupled together to assemble a multi-sectional MWD tool.
Figure 6B:
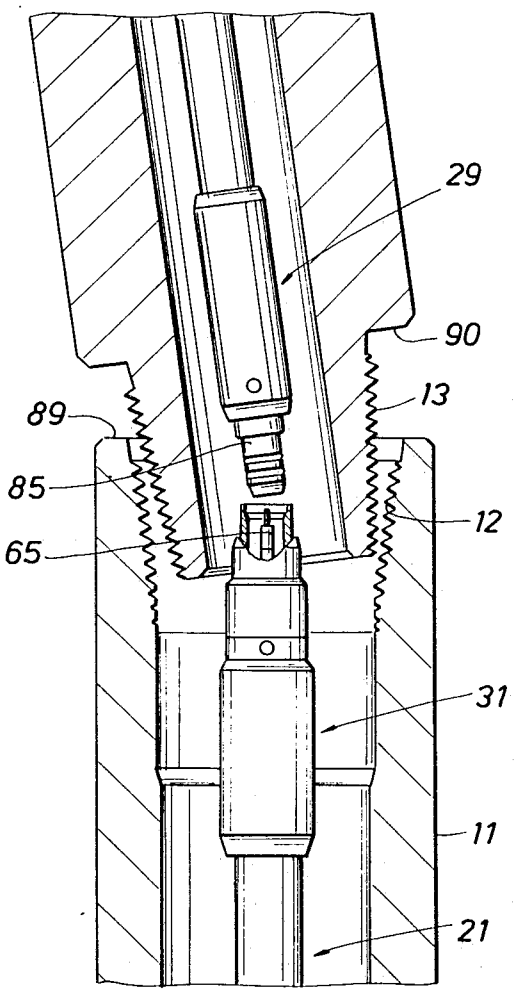
Figure 6A:
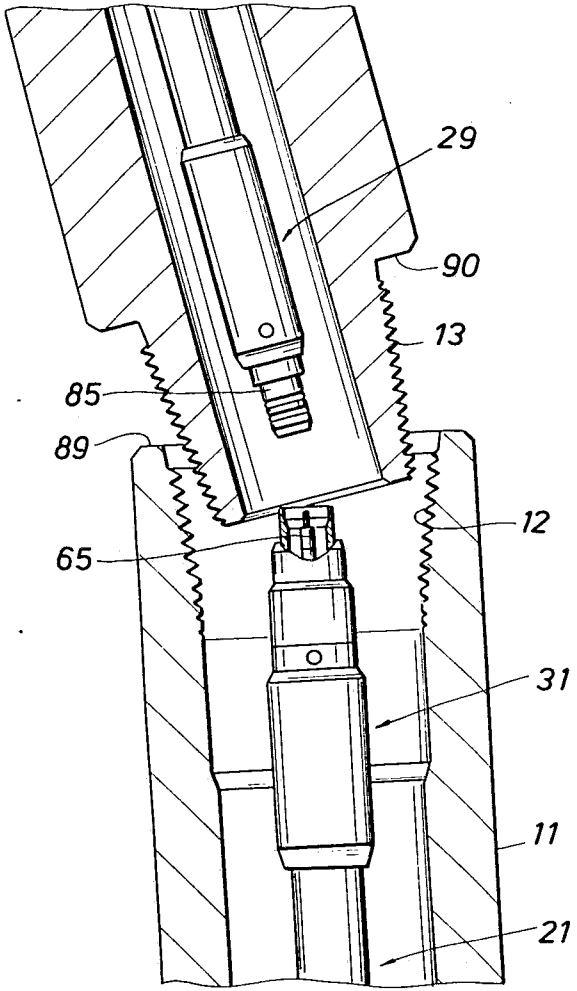

Turning now to FIGS. 6A–6C, successive views are shown of the end portions of two tool bodies 11 as the threaded male portion 13 of the upper tool body is being lowered into the threaded female portion 12 of the lower body to tandemly couple the two bodies. In keeping with the preceding description of the principles of the present invention, the two connectors 29 and 31 have been manually adjusted as respectively needed to correctly position them in the internal bores of the tool bodies. With the connectors 29 and 31 positioned as illustrated, they are, of course, well guarded from damage as the tool bodies are being separately handled prior to the illustrated coupling operation.

Those skilled in the art will, of course, recognize that as a multi-sectional MWD tool is being assembled, it is not always easy to accurately align the tool bodies and then guide the male threaded portion or pin end of one heavy tool body into the female threaded or box end of another tool body. This is particularly true when a multi-sectional tool is being assembled while the lower tool sections are supported at the top of the well bore by the slips on the rotary table by lowering the next tool section into position and tightening it with a so-called "spinning chain" or tongs on the rig floor.

Accordingly, in keeping with the objects of the present invention, the lower connector 31 is sufficiently recessed in the upper end of the lower tool body 11 that the connector will not be struck by the male or pin end 13 of the other tool body as this threaded end portion is initially lowered into the box portion 12 of the lower tool body. Even should the upper tool body be badly misaligned as shown in FIG. 6A, as successively depicted in FIGS. 6B and 6C, the upper tool body will be progressively moved into axial alignment with the lower tool body as the male threads 13 begin to coengage the female threads 12. It will be recognized, of course, that as the tool bodies are drawn together by the threads 12 and 13, the connectors 29 and 31 will be brought together and cooperatively coupled together. It should be noted that even should there be a slight misalignment between the connectors 29 and 31, the spring 62 will compress sufficiently to allow the engagement of the threads 12 and 13 bring the tool bodies and the connectors into axial alignment without risking damage to the connectors.

Accordingly, it will be appreciated that the present invention has provided new and improved apparatus for reliably and quickly interconnecting the several sections of a multi-sectional well tool such as a MWD tool. By cooperatively arranging mating upper and lower electrical connector means on the ends of elongated support members which are adapted to be releasably mounted on the opposite ends of a fluidly-sealed enclosure mounted within a tool body and carrying one or more electrical devices or circuitry, these electrical connector means can be adjustably positioned on their respective support members for accurately locating the connector means with respect to the ends of the tool body. In this manner, as the tool body is threadedly coupled to other similarly arranged tool bodies, their respective connectors will be reliably and safely interconnected. Moreover, by providing pressure-biasing means on at least one of these connector means, the hydrostatic pressure of the borehole fluids will ensure that the connectors remain interconnected with one another.

While only one particular embodiment of the present invention has been shown and described herein, it is apparent that various changes and modifications may be made thereto without departing from this invention in its broader aspects; and, therefore, the aim in the appended claims is to cover all such changes and modifications as fall within the true spirit and scope of this invention.

What is claimed is:

1. A well tool comprising:

a first tubular body having an end portion with internal tapered threads;

a second tubular body having an end portion with external tapered threads adapted to be coengaged within said internally-threaded end portion of said first tool body for drawing said tool bodies together and into axial alignment along a common longitudinal axis as said tool bodies are rotated relative to one another to threadedly couple said tool bodies together;

first and second electrical connector means coaxially arranged within said first and second bodies respectively and adapted to be interconnected with one another as said tool bodies are threadedly coupled together; and first and second mounting means respectively arranged within said first and second bodies and adapted to be selectively adjusted for axially positioning said first and second connector means therein before said tool bodies are threadedly coupled together so that said externally-threaded end portion of said second tool body will not contact said first connector means as said threaded end portions are being initially coengaged and said first and second electrical connector means will be interconnected as said tool bodies are being subsequently drawn into axial alignment.

2. The well tool of claim 1 further including:

first electrical means arranged within said first tool body; and means electrically interconnecting said first electrical means and said first electrical connector means.

3. The well tool of claim 2 further including:

second electrical means arranged within said second tool body; and means electrically interconnecting said second electrical means and said second electrical connector means.

4. The well tool of claim 1 further including:

a first pressure-tight enclosure arranged within said first tool body;

first electrical means enclosed within said first pressure-tight enclosure;

means on said first electrical connector means cooperatively supporting said first pressure-tight enclosure within said first tool body; and means electrically interconnecting said first electrical means and said first electrical connector means.

5. The well tool of claim 4 further including:

a second pressure-tight enclosure arranged within said second tool body;

second electrical means enclosed within said second pressuretight enclosure;

means on said second electrical connector means cooperatively supporting said second pressure-tight enclosure within said second tool body; and means electrically interconnecting said second electrical means and said second electrical connector means.

6. The well tool of claim 1 further including:

means responsive to the pressure of fluids within said tool bodies and adapted for biasing said first and second electrical connector means toward one another with an axial force proportional to that pressure.

7. The well tool of claim 5 wherein said pressure-tight enclosures are fluid filled and further including:

means responsive to the pressure differential between the fluids within and outside of said first and second enclosures for biasing said first and second electrical connector means together with a force proportional to that pressure differential.

8. A multi-sectional well tool comprising:

a first body having an axial bore defining a fluid passage and an externally-threaded male end portion;

a second body having an axial bore defining a fluid passage and an internally-threaded end portion adapted to threadedly receive said male end portion and draw said tool bodies into axial alignment as they are rotated relative to one another about their respective longitudinal axes to tandemly couple said tool bodies;

first and second connector means respectively arranged within said end portions of said first and second bodies and including mating male and female electrical connectors coaxially disposed on said axes and adapted for mating engagement when said tool bodies are coupled, and means cooperatively arranged to isolate said mated electrical connectors from fluids in said fluid passages when said tool bodies are coupled;

first and second mounting means cooperatively supporting said first and second connector means within said first and second bodies respectively and adapted to be selectively adjusted for positioning said electrical connectors along their respective axes so that said male end portion of said first tool body can not contact said electrical connector in said second tool body as said threaded end portions are being initially coengaged and said electrical connectors will thereafter be matingly engaged as said tool bodies are being drawn into axial alignment; and means adapted for operation in response to the pressure of fluids in said fluid passages when said tool bodies are coupled for biasing said electrical connectors together.

9. The well tool of claim 8 further including:

first electrical means arranged within said axial bore of said first tool body; and means electrically interconnecting said first electrical means and said electrical connector in said first tool body.

10. The well tool of claim 9 further including:

second electrical means arranged within said axial bore of said second tool body; and means electrically interconnecting said second electrical means and said electrical connector in said second tool body.

11. The well tool of claim 8 further including:

a first pressure-tight enclosure arranged within said axial bore of said first tool body;

first electrical means enclosed within said first pressure-tight enclosure;

means on said first connector means cooperatively supporting said first pressure-tight enclosure within said first tool body; and means electrically interconnecting said first electrical means and said electrical connector in said first tool body.

12. The well tool of claim 11 further including:

a second pressure-tight enclosure arranged within said axial bore of said second tool body;

second electrical means enclosed within said second pressure-tight enclosure;

means on said second electrical connector means cooperatively supporting said second pressure-tight enclosure within said second tool body; and means electrically interconnecting said second electrical means and said second electrical connector means.

13. The well tool of claim 12 wherein said pressure-tight enclosures are fluid filled and further including:

means responsive to the pressure of fluids in said pressure-tight enclosures cooperable with said means biasing said electrical connectors together for developing a biasing force thereon that is proportional to the pressure differential between the fluids in said fluid passages and the fluids in said pressure-tight enclosures.

14. A tool sub adapted to be tandemly coupled to other tool subs for assembling a multi-sectional well tool and comprising:

a tool body having an axial bore defining a fluid passage between first and second threaded end portions of said tool body;

a pressure-tight enclosure disposed within said axial bore;

electrical means enclosed within said pressure-tight enclosure;

means including first and second end members sealingly engaged with the opposite ends of said pressure-tight enclosure for coaxially supporting said pressure-tight enclosure within said axial bore;

and first and second connector means respectively arranged within said axial bore between said first end member and said first threaded end portion of said tool body and between said second end member and said second threaded end portion of said tool body, each of said connector means including an electrical connector coaxially disposed in said axial bore within the adjacent threaded end portion and facing outwardly for mating engagement with another connector, an elongated support member releasably mounted on the adjacent end member and extending outwardly therefrom, and mounting means supporting said electrical connector movably coupled to said elongated support member and adapted to be manually adjusted in relation thereto for selectively positioning said electrical connector within said axial bore.

15. The tool sub of claim 14 further including:

means adapted for operation in response to the pressure of fluids in said fluid passage when said tool sub is coupled to another tool sub for biasing at least one of said electrical connectors into engagement with the mating electrical connector in such other tool sub.

16. The tool sub of claim 14 further including:

first and second means electrically interconnecting said electrical means and each of said electrical connectors.

* * * * *